United States Patent [19]

Klümpp

[11] Patent Number: 4,709,614

[45] Date of Patent: Dec. 1, 1987

[54] THROWING DEVICE FOR FIRING INCANDESCENT BODIES

[75] Inventor: Walter Klümpp, Duisburg, Fed. Rep. of Germany

[73] Assignee: Rheinmetall GmbH, Duesseldorf, Fed. Rep. of Germany

[21] Appl. No.: 910,112

[22] Filed: Sep. 19, 1986

[30] Foreign Application Priority Data

Sep. 19, 1985 [DE] Fed. Rep. of Germany ..... 3533417

[51] Int. Cl.[4] ..... F41F 1/06

[52] U.S. Cl. ..... 89/1.35; 89/37.05

[58] Field of Search ..... 89/1.3, 1.35, 1.816, 89/37.05, 40.02

[56] References Cited

U.S. PATENT DOCUMENTS

| | | | |
|---|---|---|---|
| 1,334,414 | 3/1920 | Stokes | 89/1.35 |
| 1,387,308 | 8/1921 | Post | 89/1.35 |
| 2,051,927 | 8/1936 | Wiley | 89/37.05 |
| 2,353,885 | 7/1944 | Fanger et al. | 89/1.3 X |
| 2,378,691 | 6/1945 | Fanger et al. | 89/1.3 X |
| 2,383,087 | 8/1945 | Shaffer | 89/1.35 |
| 2,597,031 | 5/1952 | Posey | 89/1.35 |
| 2,818,780 | 1/1958 | Saloranta et al. | 89/1.35 X |
| 3,750,529 | 8/1973 | Reed et al. | 89/1.816 X |

FOREIGN PATENT DOCUMENTS

| | | | |
|---|---|---|---|
| 227119 | 4/1963 | Austria | 89/1.3 |
| 325288 | 6/1936 | Italy | 89/1.3 |

OTHER PUBLICATIONS

European Patent Search.

*Primary Examiner*—David H. Brown

[57] ABSTRACT

A light and portable throwing device which can be carried and operated by only one person, for firing incandescent bodies that light large combat areas, comprising a separable firing tube which carries in its partial tube sections individual lighting elements in a container, and which separable firing tube can be quickly mounted in a base plate socket of a base plate. A releasable bayonet ring holds the spherical part of the firing tube in the base plate. A selector dial, rotatably positioned around the extended bore axis has individual support surfaces. During contact with a datum surface, each support surface has a given fixed predetermined angle of inclination between the bore axis and a gauge on the datum surface which corresponds to a respective throw distance for an incandescent body. A grip handle piece on the separable firing tube covers the center of gravity G of the throwing device and allows for the one handed carrying of the complete apparatus. A muzzle sided operable holding device is provided with a handhold.

3 Claims, 10 Drawing Figures

FIG. 3
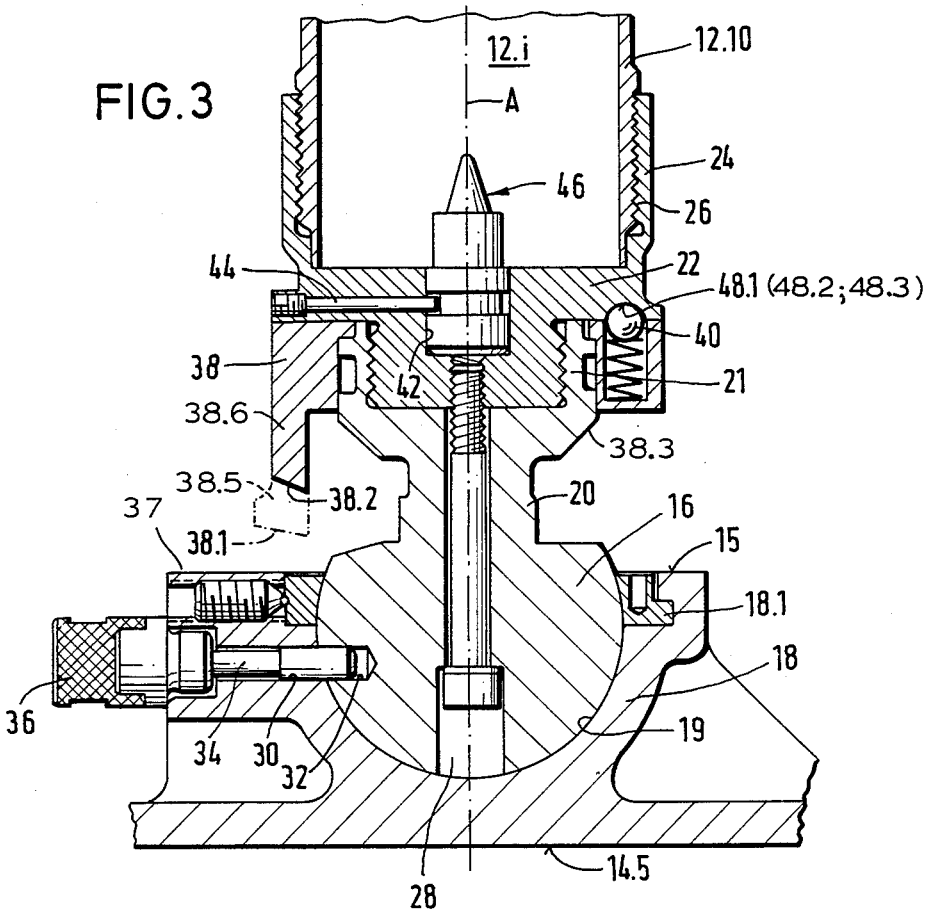
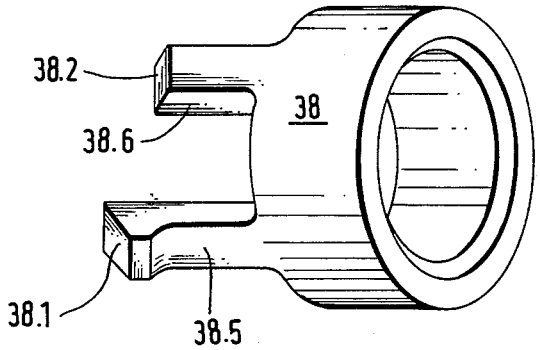
FIG. 4

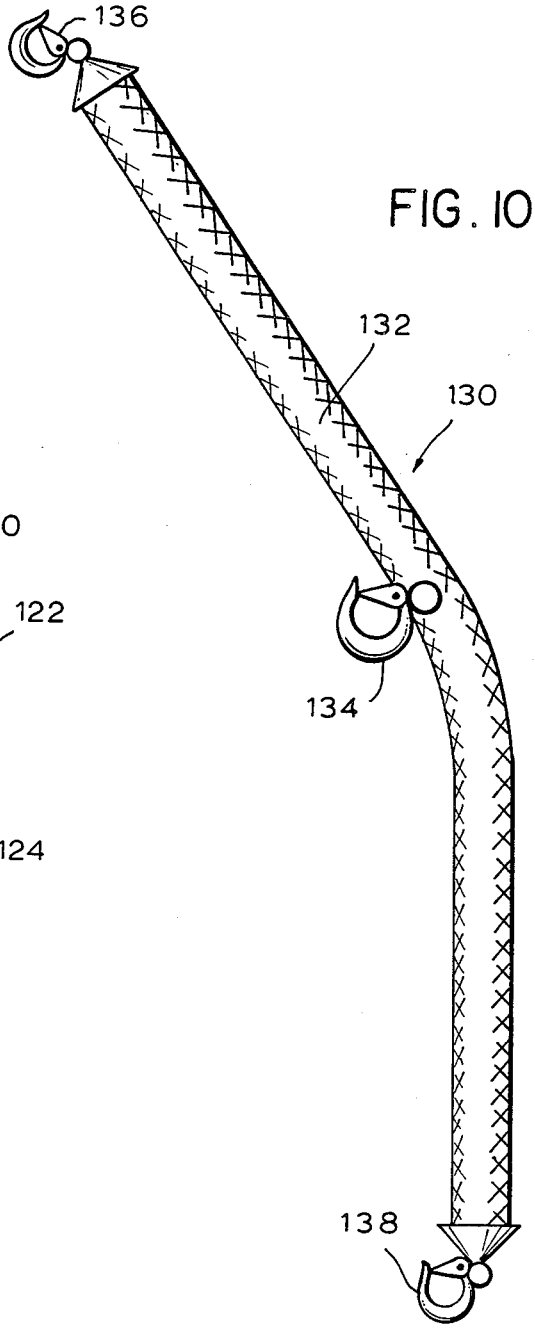
FIG. 10
FIG. 9
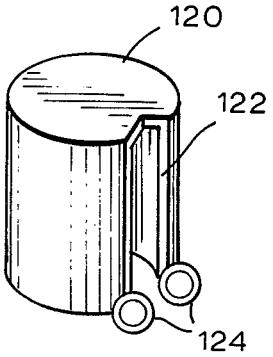

THROWING DEVICE FOR FIRING INCANDESCENT BODIES

SUMMARY OF THE INVENTION

The present invention relates to a new and improved throwing device which can be easily transported, assembled, disassembled and used for firing incandescent bodies by only one person.

DESCRIPTION OF THE PRIOR ART

A pyrotechnic pistol, is known in the art and generally represents the same species as the present invention. Due, however, to its very short range, the size of the area illuminated with sufficient intrinsic brilliance of luminous surface, is insufficient.

For very large combat area illumination, incandescent bodies are also known to be fired out, as special ammunition, of howitzers and grenade firing devices. The performance of this prior known device, however, has the disadvantage of requiring a considerable expenditure in both additional machinery and personnel, which frequently may be preventative under certain combat conditions.

The object of the present invention is to create a throwing device of the same general species as noted above but with increased performance in its unitary transportability, assembly and operation.

BRIEF DESCRIPTION OF THE DRAWINGS

This object is met by the features disclosed in the present application wherein a throwing device for firing incandescent bodies is disclosed which by its improved structure can be easily transported, assembled, fired, disassembled, repacked and then again carried by a single person. These and other objects and features of the invention will become apparent with reference to the following detailed specification when read together with the following schematic illustrations, wherein:

FIG. 3 is an enlarged longitudinal axis cross section of section III in FIG. 1.

FIG. 4 is a detail of FIG. 3 in perspective illustration,

FIG. 9 is a perspective illustration of a muzzle cover.

FIG. 10 is a perspective illustration of a carrying strap.

DETAILED SPECIFICATION

Figure 1:
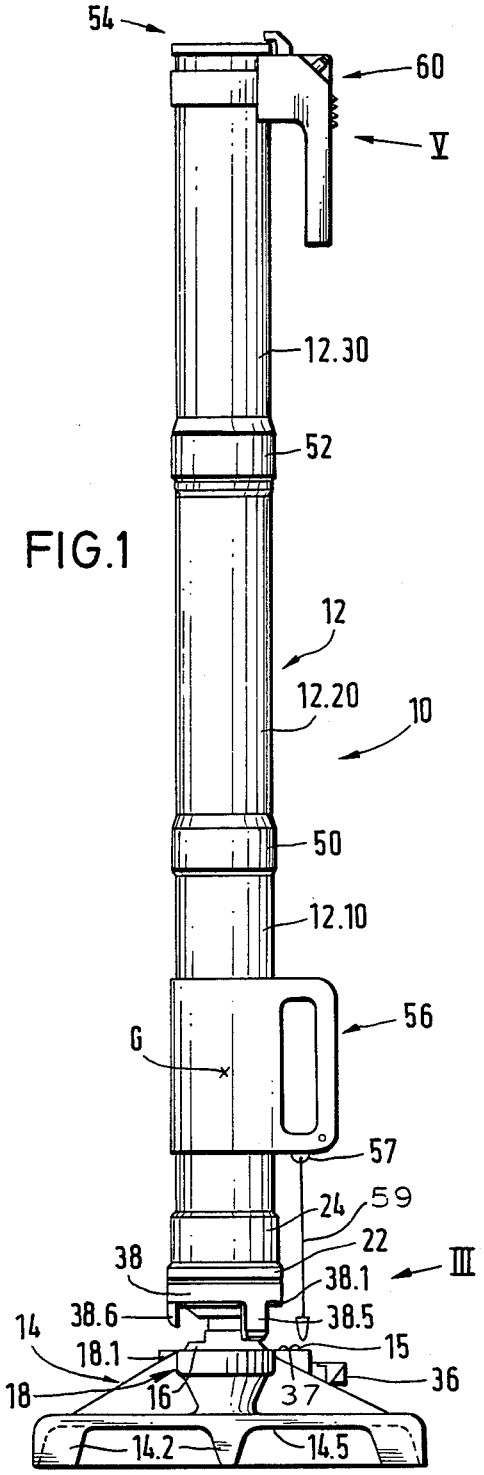
FIG. 1 is a complete vertical layout of the throwing device according to the invention.
Figure 2:
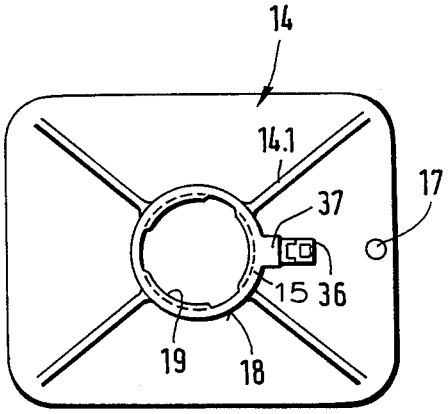
FIG. 2 is a top view of the base plate.
Figure 5:
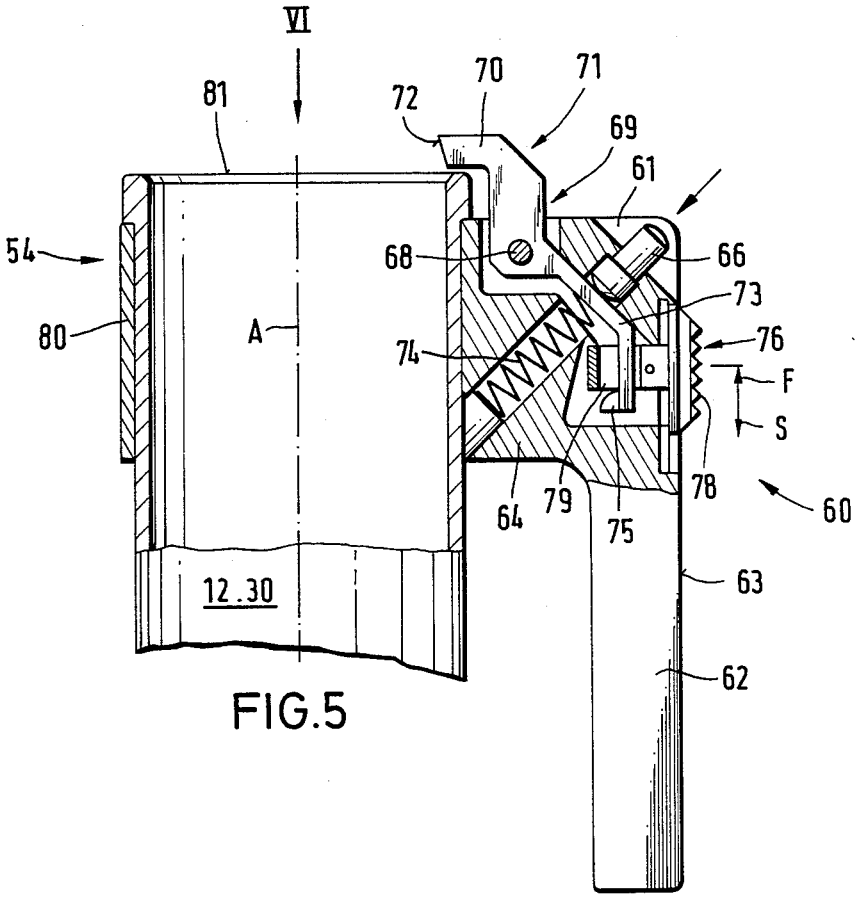
FIG. 5 is an enlarged longitudinal axis cross section of section V in FIG. 1.
Figure 6:
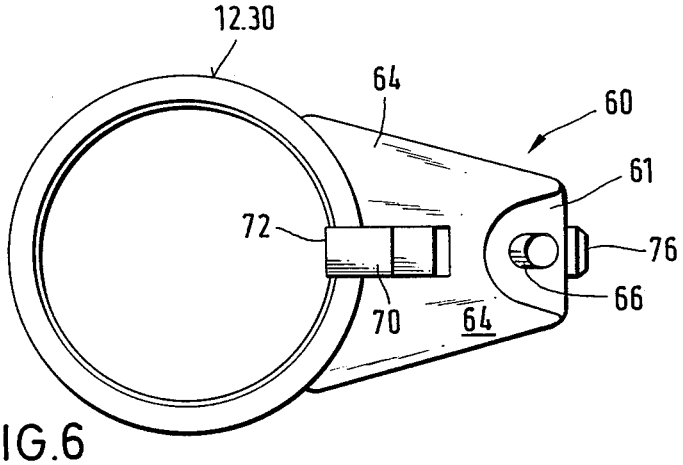
FIG. 6 is a view in the direction of the arrow VI in FIG. 5.

Referring to FIGS. 1 and 3, a throwing device 10 is shown having a tube 12 which is flexibly supported and held on one end by a spherical part of a universal joint 16 by means of a bayonet ring 18.1, in a base plate socket 19 in the top side base body 18 of a base plate 14. The spherical part 16 is connected with a releasable thread connection by means of a throat 20 with a tube plate 22 whose top side ends in a junction collar 24 with a female thread 26. A bore 28, diametrically penetrating the spherical part 16, is aligned with a graduated bore 42 in the tube plate 22 and serves to receive a rigid firing pin 46 protruding into an inner space 12.i of the tube, which is interchangeably fastened with a holding screw 44 in the tube plate 22. A selector dial 38 with support surfaces 38.1, 38.2, 38.3 is rotatably positioned between a throat sided top portion 21 and the tube plate 22 around the elongated bore axis A, terminally limiting the first two axial protrusions 38.5 and 38.6. The bayonet ring 18.1 is limited on the top side by an even datum surface 15, said surface arranged parallel (surfacewise) to a bottom sides surface 14.5 of the base plate 14. The base body 18 shows a bore 30 for the operation of a bolt formed index stop 34 with handle 36 for the purpose of releasably setting the spherical part 16 over a bore 32, in such a way that the bore axis A stands vertical to the plane set on the datum surface 15. The selector dial 38 has an integrated spring-loaded stop ball 40 which can be engaged with the marking settings 48.1, 48.2, and 48.3 in the tube plate 22 by turning the selector dial 38. The tube 12 comprises partial tubes 12.10, 12.20, and 12.30. Prior to fastening the first partial tube 12.10 to the tube plate 22, a grip handle piece 56 slides over the partial tube 12.10 and is fixed in the circumferential and axial direction in a predetermined releasable manner such that the center of gravity G of the throwing device 10 is covered by the center of the grip handle 56. The partial tube 12.20 is releasably connected to the partial tube 12.10 by means of a sleeve 50. The sleeve 52 serves to releasably connect the partial tube 12.30 with the partial tube 12.20. A holding device 60, as also shown in FIGS. 5 and 6, is releasably attached by means of the bracket lock (not shown) of a pipe clamp 80 to the muzzle region 54 of the partial tube 12.30 in such a way that a frontal surface 72 (explained in greater detail below) projects over the muzzle plane 81 in the direction of the bore axis A, and a handhold 62 is in alignment with the grip handle 56. The holding device shows a bearing body 64 with the handhold 62, and a two armed lever 69 deflectably mounted in pin 68 against a restoring spring 74. The first lever arm 71 ends in a holding nose 70 with the already mentioned frontal surface 72. The second lever arm 73 is pressed by the restoring spring 74 and is deflectable against the latter by means of a release button 66 (in a recess 61). A safety slide 76, operationally arranged in the vicinity of the release button 66, projects over the top side 73 of the handhold 62 with a ribbed operating surface 78 which is gentle to the users skin, and allows itself to be moved in the directions of the oppositely directed arrows F and S. By means of the last mentioned movement a blocking end 75 of the lever arm 73 becomes lodged into a penetration grip 79 of the safety slide 76 and prevents the deflection of the lever by means of the release button 66.

Figure 7:
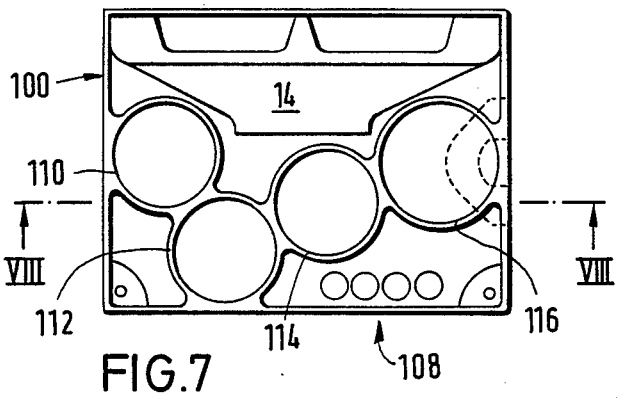
FIG. 7 is a transport container in a cross sectional view across the axis direction of the partial tubes.
Figure 8:
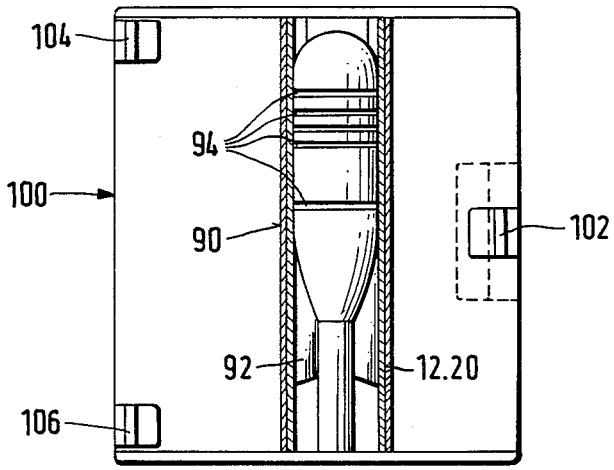
FIG. 8 is the container in a cross section in accordance with the line VIII—VIII in FIG. 7.

FIGS. 7 and 8 show the arrangement of the disassembled throwing device 10 in a container 100 for transport and storage. Receptacles 108 are for tools and/or spare firing pins. Receptacles 110, 112 and 114 are intended for partial tubes 12.10, 12.20 and 12.30. Receptacle 116 is, among other things, designed for the tube plate 22 with sleeve 24, selector dial 38 and spherical part 16. The inner space 12.i of the partial tubes 12.10, 12.20 and 12.30 serve as receptacles for individual incandescent bodies 90 with propellant charge and tail unit 92, and peripheral grooves 94. A carrying strap 130 with spring safety hooks 134, 136 and 138 can be attached to the regions 102, 104 and 106 of the container 100 for purposes of back loading capability. Region 102 can also serve as grip handle. For the purpose of ergonometrically preferred carrying of the throwing device 10 in its deployable condition as shown in FIG. 1, the carrying strap 130 with the spring safety hook 136 or 138 can be fastened to an opening 17 of the base plate 14 and, in the muzzle region 54, to the eye ring 124 of the muzzle cover 120 shown in FIG. 9.

In order to assemble the throwing device 10 in the condition shown in FIGS. 1 and 3 the following procedure is followed: The base plate 14 is sunk into the ground with the bottom sided ground spurs 14.2 in such a way that the tube 12 stands vertically upright. In this manner the datum surface 15 is in the horizontal position. After pulling the index stop 34 out of the bore 32 of the spherical part 16, the tube 12 can be lowered in such a manner that one of the support surfaces 38.1, comes into contact with the datum surface 15. Thereby the tube elevation is dependent upon the axial extension of the protrusion 38.5 or 38.6, or the lack of any protrusion whatsoever. The handles 62 and 56 are aligned and the tube angle can be predetermined for a certain throw distance by means of the selector dial 38. The sighting angle can thereby be extended by at least one full circle of azimuth. An eyelet 57 can be arranged on the grip handle 56 for the releasable attachment of a plumb bob. A reference point 37 is provided for the latter which allows for the sufficient leveling of the base plate 14 by simple means and without further means of assistance.

If the distance is given with a preset tube azimuth, then the throw direction azimuth can be set by swinging by tilting the tube 12 to the side.

An incandescent body 90 is inserted into the tube 12 on the muzzle side for preparation of the throwing device operation, such that the holding nose 70 locks into one of the grooves 94 with the frontal surface 72. The safety slide 76 pushed into the direction S prevents any possibility of firing the incandescent body 90. The user can, therefore, after presetting the distance, aim the side by simple means. This occurs by means of the handhold 62. When the desired position is achieved, it is only necessary to move the safety slide 76 in the direction of the arrow F and therewith the thumb in the vicinity of the release button 66. Thus, the thumb can easily, through further movement, leave the surface 78 and press the release button 66 to initiate the throwing process by known means. The above description clearly shows in an emphatic manner the transportability and operation of the throwing device by only one person, whereby the final phase of the operation is performed with one hand.

Although the invention is described and illustrated with reference to a preffered embodiment thereof, it is to be expressly understood that it is in no way limited to the disclosure of such preferred embodiment but is capable of numerous modifications within the scope of the appended claims.

I claim:

1. A throwing device preferably for firing incandescent bodies which, together with a predetermined number of incandescent bodies, can be transported, assembled, operated, and disassembled, by only one person, comprising, a tube with a bore axis therethrough, having a muzzle on one end; and a base plate;

said tube is operatively mounted on the base plate by a tube plate which is opposite the muzzle end of the tube; said tube is provided with a firing pin and a spherical part of a universal joint, having a bore on one side, and arranged near the firing pin at the tube end; said base plate having a base plate socket which is operatively connected to the spherical part of the tube;

a selector dial for predialing a predetermined tube angle and throw distance, said dial is rotatably arranged on the tube near the spherical part; the tube is separable into partial tube sections; and an operable holding device is placed at the muzzle end of the firing tube,.

2. A throwing device according to claim 1 having parts for the adjustment of the throwing device, comprising, an operable index stop, located in the bore of the spherical part for the purpose of releasably setting the spherical part and thereby the firing tube;

a datum surface of the base plate, wherein the bore axis of the tube forms a right angle with the horizontal plane of the datum surface when the tube is mounted in the base plate; the tube plate has marking settings whereby a respective support surface is assigned to each marking setting; the support surfaces are arranged in various lengths on respective axial protrusions; the marking settings are arranged in predetermined divisions around the bore axis of the tube; each support surface has assigned to it a predetermined tube angle during engagement with the datum surface of the horizontally positioned base plate whereby the tube is freely movable into the respective throw direction.

3. A throwing device according to claim 2, wherein, the partial tube sections are arranged in a container form so that each partial tube section can serve as a receptacle for an incandescent body, and the container can be transported by known means.

* * * * *

UNITED STATES PATENT AND TRADEMARK OFFICE

CERTIFICATE OF CORRECTION

PATENT NO. : 4,709,614

DATED : December 1, 1987

INVENTOR(S) : Walter KLUMPP

It is certified that error appears in the above-identified patent and that said Letters Patent are hereby corrected as shown below:

On the title page, inventor name should read

-- Walter Klumpp --.

Signed and Sealed this

Twenty-sixth Day of April, 1988

*Attest:*

DONALD J. QUIGG

*Attesting Officer*

*Commissioner of Patents and Trademarks*